US006991469B1

(12) United States Patent
Wang

(10) Patent No.: US 6,991,469 B1
(45) Date of Patent: Jan. 31, 2006

(54) SWIVEL PLUG

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 50 days.

(21) Appl. No.: 10/918,438

(22) Filed: Aug. 16, 2004

(51) Int. Cl.
*H01R 39/00* (2006.01)

(52) U.S. Cl. ..... 439/31

(58) Field of Classification Search ..... 439/31, 439/11–13, 104, 174, 171, 173, 131, 640; 29/882, 524.1, 509; 411/504, 506, 507
See application file for complete search history.

(56) References Cited

U.S. PATENT DOCUMENTS 2,305,101 A * 12/1942 O'Brien ..... 439/4
2,465,654 A * 3/1949 Harper ..... 439/742
3,927,458 A * 12/1975 Speakman ..... 29/407.05
4,007,540 A * 2/1977 Tyree ..... 29/509
5,499,440 A * 3/1996 Satoh et al. ..... 29/512
5,567,181 A * 10/1996 Lentz et al. ..... 439/694
5,658,152 A * 8/1997 Selker ..... 439/31
5,692,921 A * 12/1997 Jennings ..... 439/346
6,663,396 B1 * 12/2003 Wang ..... 439/31

* cited by examiner

*Primary Examiner*—Phuong Dinh
(74) *Attorney, Agent, or Firm*—Rosenberg, Klein & Lee

(57) ABSTRACT

A swivel plug is disclosed to have each metal conducting plug element of the front plug body provided with a male coupling end and each terminal of the rear plug body provided with a female coupling end pivotally coupled to the male coupling end of the respective metal conducting plug element, which female coupling end having a coupling hole with a tapered periphery, which male coupling end having a split protrusion inserted into the coupling hole of the female coupling end expanded into radial spring arms that pressed on the tapered periphery of the coupling hole.

10 Claims, 14 Drawing Sheets

SWIVEL PLUG

BACKGROUND OF THE INVENTION a. Field of the Invention

The present invention relates to a plug and more particularly, to a swivel plug.

b. Description of the Related Art

A conventional electric plug 1, as shown in FIG. 1, has the metal conducting blades 11 axially extended from the front side of the housing 12. This design of electric plug 1 requires much vertical installation place. FIG. 2 illustrates another structure of electric plug that requires less vertical installation space. As illustrated, the electric plug 2 comprises a housing 22, two metal conducting blades 21 perpendicularly extended out of the bottom side of the housing 22, a pull ring 24 coupled to the housing 22 for pulling by hand to remove the metal conducting blades 21 from the electric socket. U.S. Pat. No. 5,567,181 discloses a similar design. This design of electric plug provides handle means to facilitate grasping. However, pulling the pull ring or handle means causes a concentration of stress. Because the housing is slightly softened when the internal circuit is bearing a load to produce heat, pulling the pull ring or handle means may cause damage to the housing. Is this design is employed to an electric plug having two metal conducting blades and one grounding prong, pulling the pull ring or handle means may bias the housing, thereby increasing pulling resistance, and much effort should be employed to remove the electric plug from the electric socket. Further, this design of electrical plug still requires much horizontal installation space.

FIGS. 3–4 show a three prong swivel plug constructed according to U.S. Pat. No. 5,658,152. According to this design, the contacts 32 of the front female plug portion and the contacts 31 of the rear male plug portion each have a laterally extending protrusion 321 or 311. The laterally extending protrusions 321 of the front female plug portion are respectively coupled to the laterally extending protrusions 311 of the contacts 31 of the rear male plug portion. This contact connection arrangement greatly reduces the height of the housing of the swivel plug. However, the contact side is unstable, not suitable for transmitting a big current. When transmitting a big current, a high temperature will be produced due to unstable contact between the contacts.

U.S. Pat. No. 6,663,396, issued to the present inventor, disclosed an electric plug having horizontal/vertical installation modes. According to this design, as shown in FIGS. 6 and 7, rivets 511, 512 are used to pivotally connect the conducting blades 41, 42 to the metal terminals 51, 52, for enabling the front housing 4 to be turned relative to the rear housing 5 about an axis X—X between two positions within 90 degrees. Referring to FIGS. 7C and 7D, when a grounding prong 43 and a grounding terminal 53 are added to the electric plug, the distance D between the two adjacent pivots 511, 531 is too short to meet the related safety code. FIGS. 8A and 8B show the rivet 511 fastened to the conducting blade 41 and the respective metal terminal 51. Because there is a limitation to the height H of the conducting blade 41 and the metal terminal 51 (normally limited to about 5–6 mm), the size of the heads and shaft of the rivet 511 must be relatively constrained, i.e., the heads and the shaft of the rivets 511 must not surpass 5 mm and 2 mm respectively. However, a relatively bigger rivet provides a relatively greater contact area and a relatively stronger retaining force. According to the embodiment shown in FIG. 8B, the rivet 511 provides a strong retaining force to join the conducting blade 41 and the metal terminal 51. However, it requires much effort to turn the conducting blade 41 relative to the metal terminal 51. According to the embodiment shown in FIG. 8C, a spring washer 512 is mounted on the rivet 511 and stopped between one head of the rivet 511 and the metal terminal 51. The use of the spring washer 512 prevents locking of the conducting blade 41 to the metal terminal 51, however it relatively increases the assembly time and cost. Further, because the heads of the rivet 511 respectively protruding over the conducting blade 41 and the metal terminal 51, thereby increasing the combined thickness T1 or T2.

Therefore, it is desirable to provide a swivel plug that eliminates the drawbacks of the aforesaid prior art designs.

SUMMARY OF THE INVENTION

The present invention has been accomplished under the circumstances in view. It is the main object of the present invention to provide a swivel plug, which has the blades (and grounding prong, if any) directly coupled to the respective terminals without the use of external rivet or pivot means to save the space and the manufacturing cost. It is another object of the present invention to provide a swivel plug, which greatly increases the contact area between the blades and grounding prong and the respective terminals, assuring positive conductivity and stable connection. It is still another object of the present invention to provide a swivel plug, which requires less installation space. It is still another object of the present invention to provide a swivel plug, which meets local electrical safety code.

To achieve these and other objects of the present invention, the swivel plug comprises a front plug body, the front plug body comprising a housing, and a plurality of metal conducting plug elements fastened to and partially extended out of the housing of the front plug body, the metal conducting plug elements each having a coupling end; and a rear plug body, the rear plug body comprising a housing coupled to the housing of the front plug body and turnable relative to the housing of the front plug body between a horizontal position and a vertical position, and a plurality of terminals, the terminals each having a coupling end respectively pivoted to the coupling ends of the metal conducting plug elements of the front plug body; wherein the coupling end of one terminal and the coupling end of the respective metal conducting plug element include a female coupling end and a male coupling end, the female coupling end having a coupling hole, the coupling hole having a tapered periphery, the male coupling end having a split protrusion protruded from one side thereof and inserted into the tapered coupling hole of the respective female coupling end, the split protrusion being expanded into at least one radial spring arm pressed on the tapered periphery of the respective coupling hole.

DETAILED DESCRIPTION OF THE PREFERRED EMBODIMENTS

Figure 1:
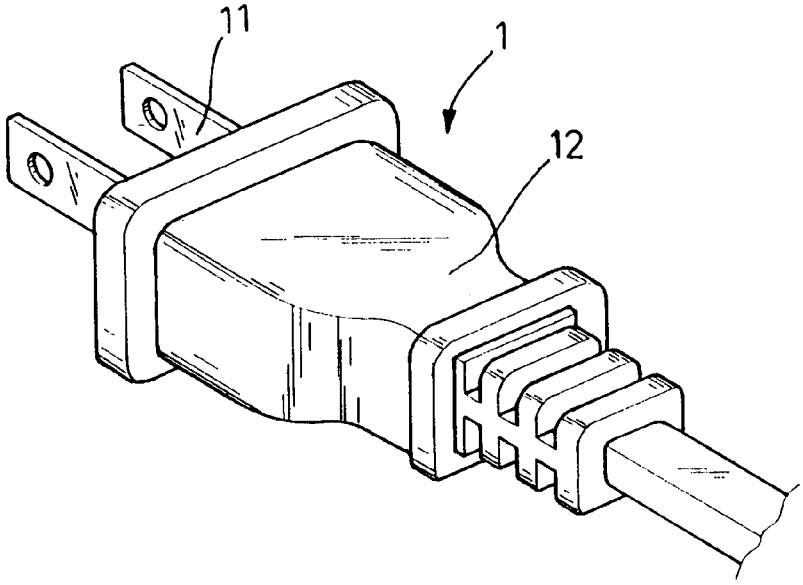
FIG. 1 PRIOR ART
FIG. 1 is an elevational view of an electric plug according to the prior art.
Figure 2:
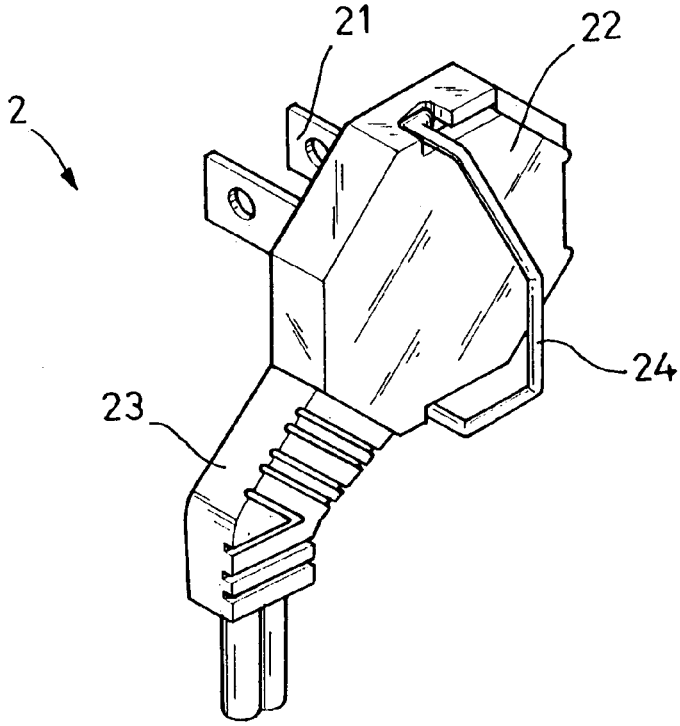
FIG. 2 PRIOR ART
FIG. 2 is an elevational view of another structure of electric plug according to the prior art.
Figure 5:
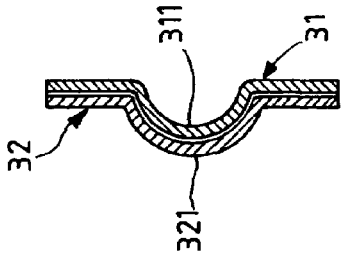
FIG.5 PRIOR ART
FIG. 5 is a sectional view taken in an enlarged scale along line 5—5 of FIG. 4.
Figure 4:
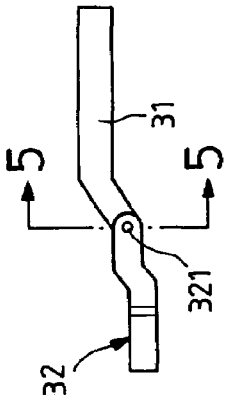
FIG.4 PRIOR ART
FIG. 4 is a schematic drawing showing the connection between contacts according to U.S. Pat. No. 5,658,152.
Figure 3:
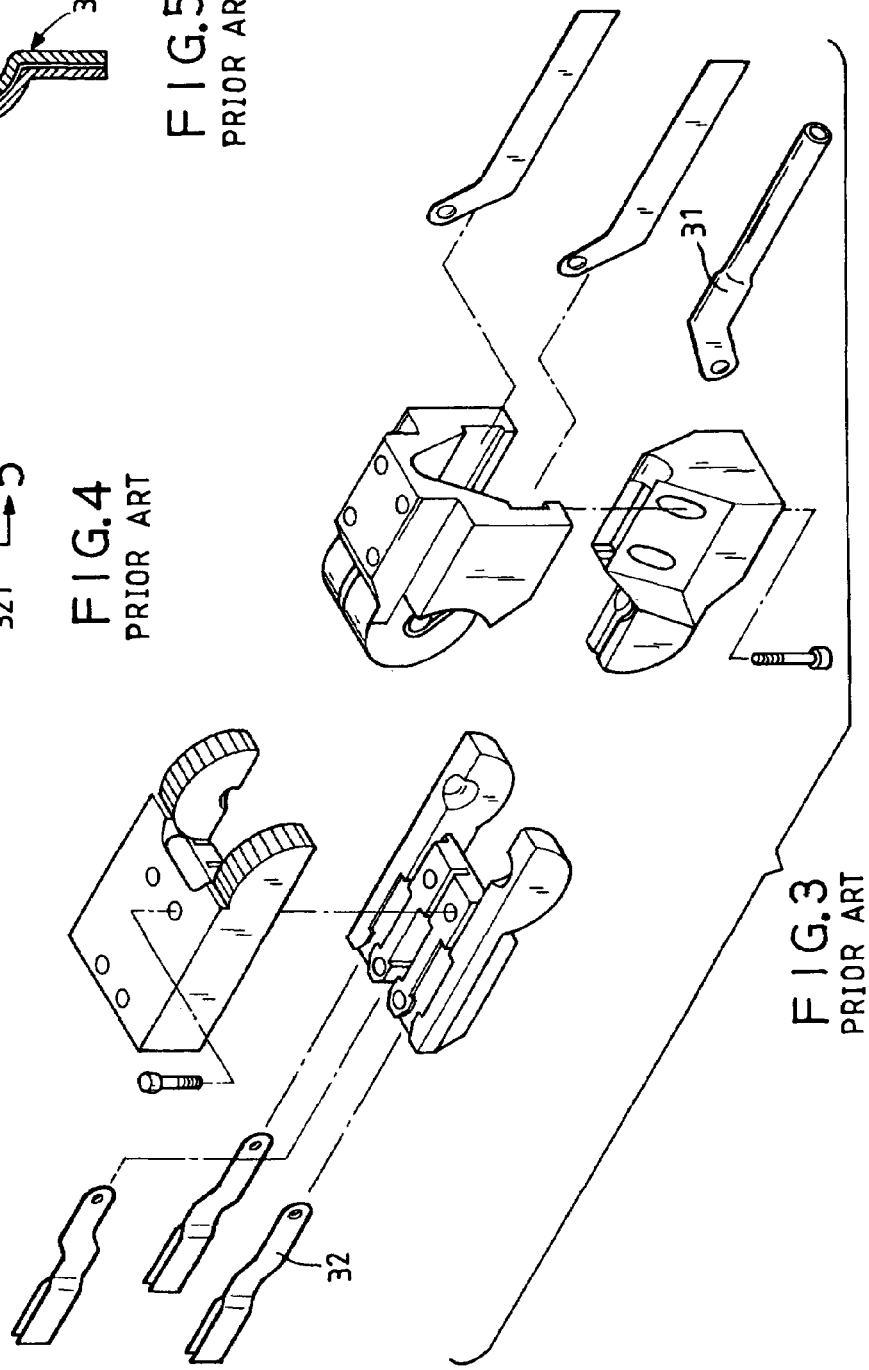
FIG.3 PRIOR ART
FIG. 3 is an exploded view of a three prong swivel plug constructed according to U.S. Pat. No. 5,658,152.
Figure 6:
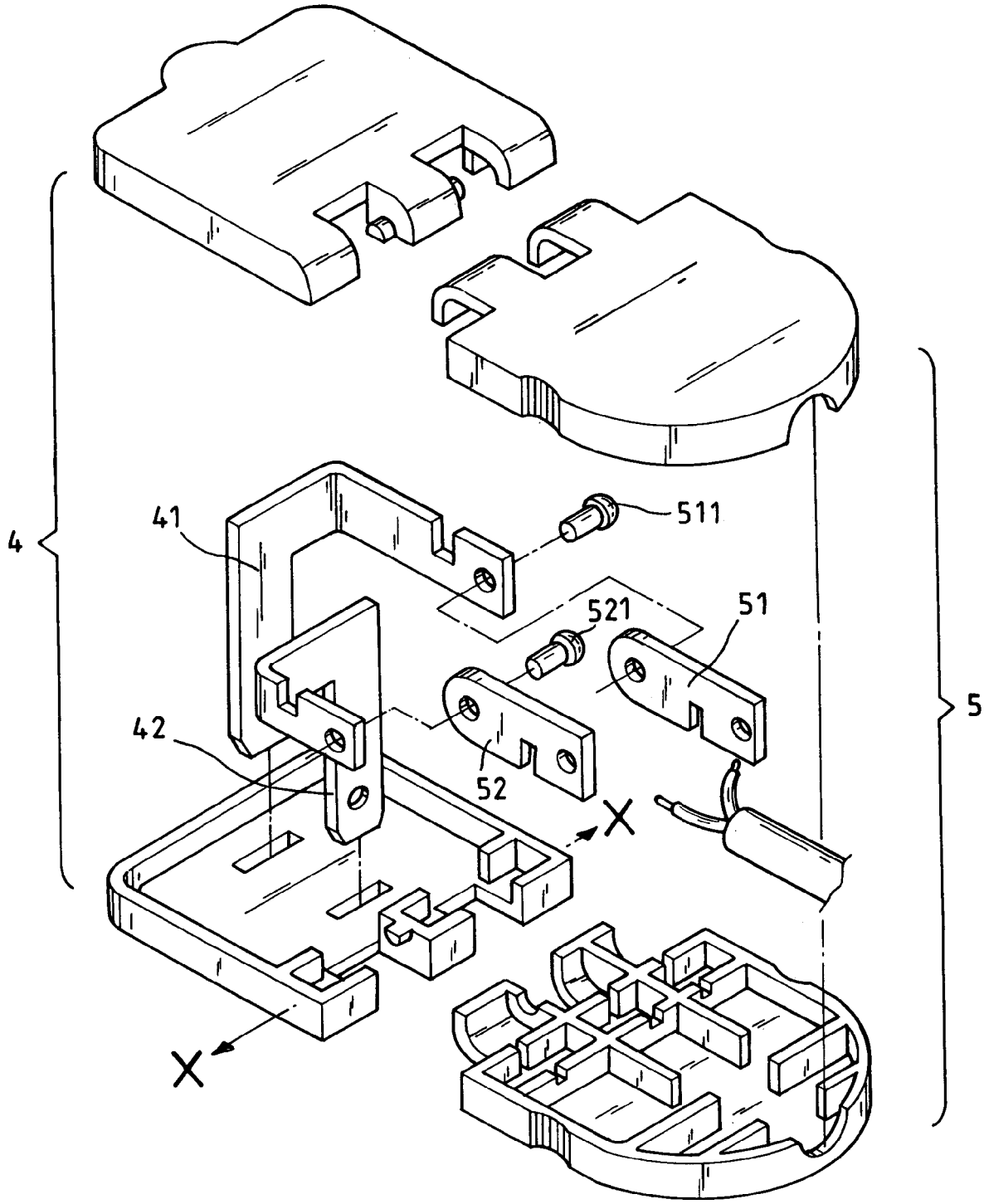
FIG. 6 PRIOR ART
FIG. 6 is an exploded view of an electric plug having horizontal/vertical installation modes according to U.S. Pat. No. 6,663,396.
Figure 7A:
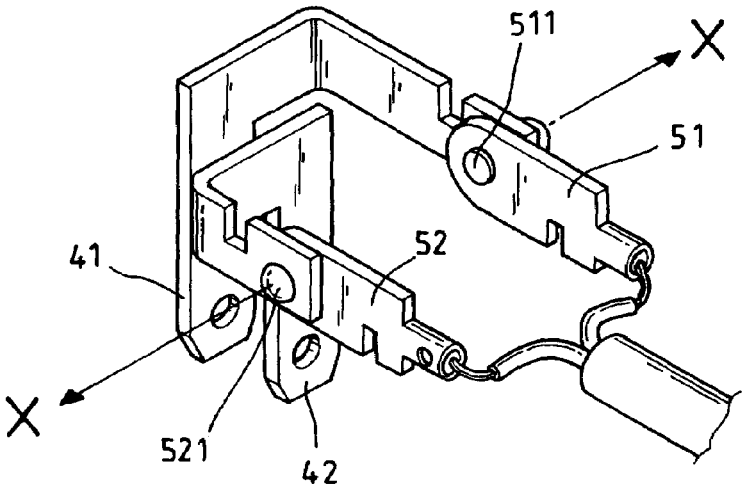
FIG.7(A) PRIOR ART
FIGS. 7A~D are schematic drawings showing connection between conducting blades and metal terminals according to U.S. Pat. No. 6,663,396.
Figure 7B:
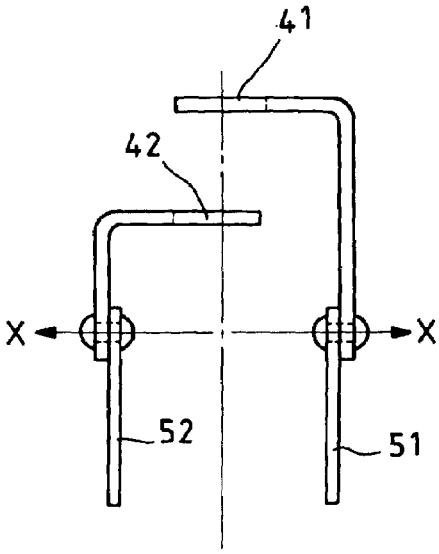
FIG.7(B) PRIOR ART
Figure 7C:
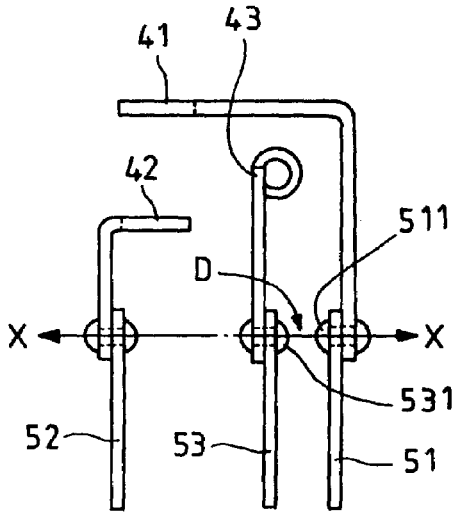
FIG.7(C) PRIOR ART
Figure 7D:
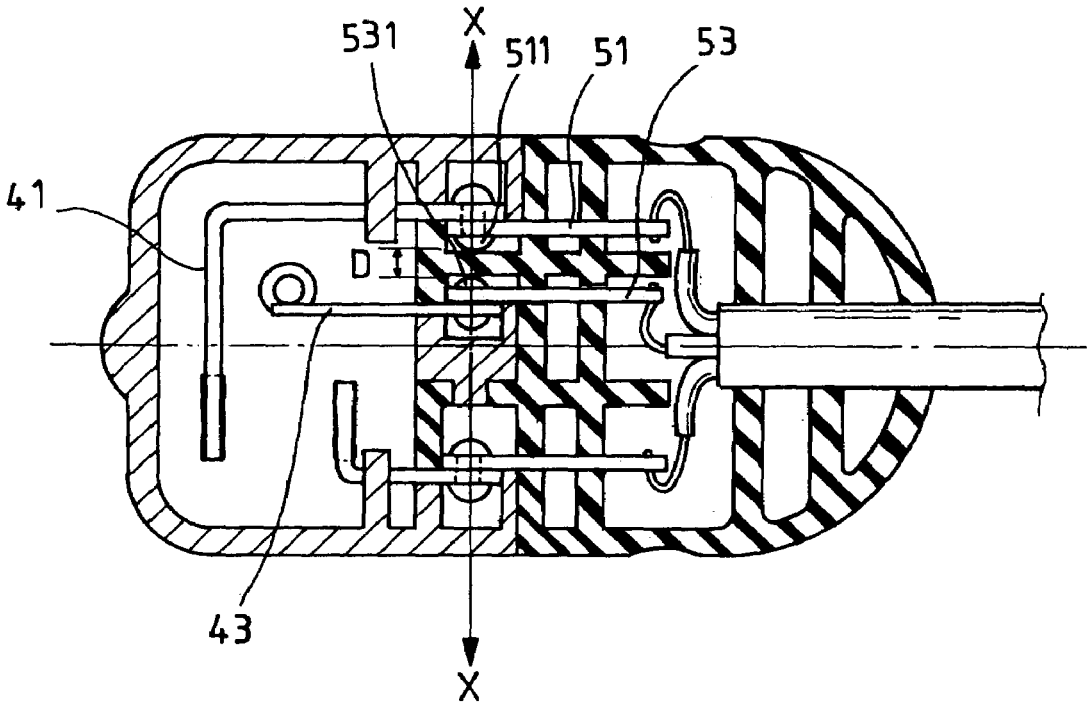
FIG.7(D) PRIOR ART
Figure 8A:
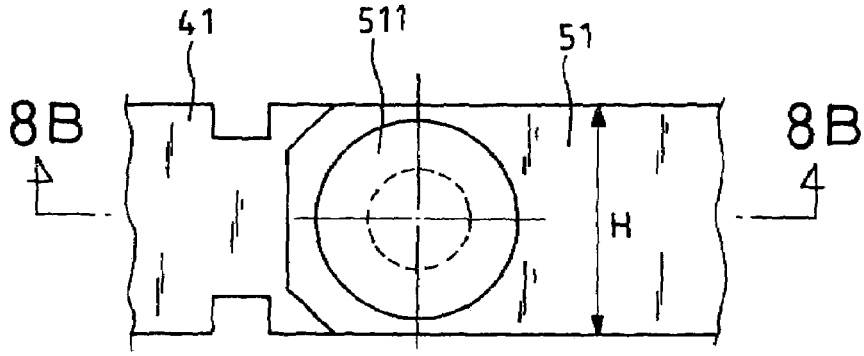
FIG.8(A) PRIOR ART
FIGS. 8A~8C are schematic drawings showing riveting structure between conducting blade and metal terminal according to the prior art.
Figure 8B:
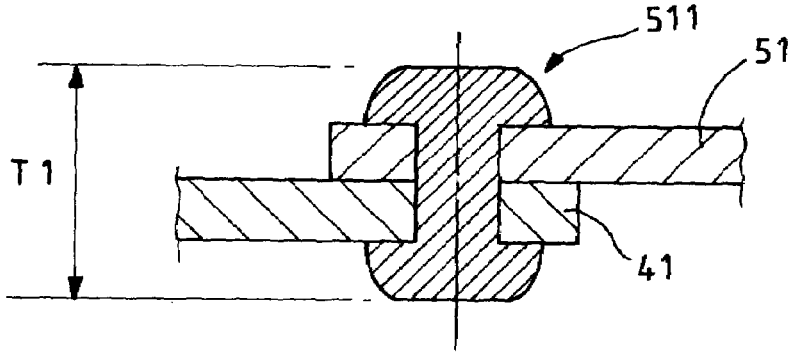
FIG.8(B) PRIOR ART
Figure 8C:
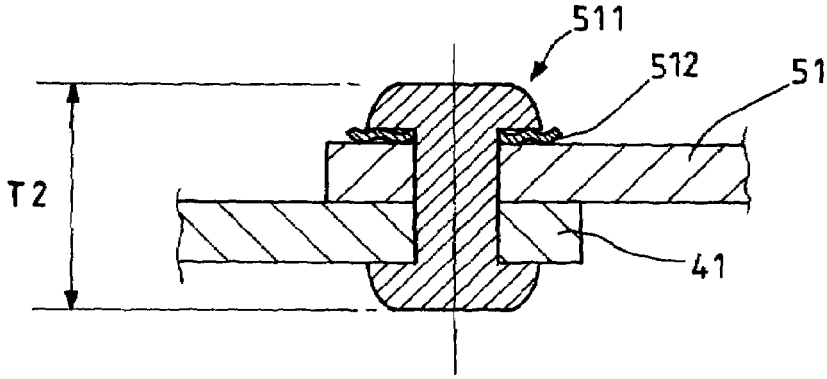
FIG.8(C) PRIOR ART
Figure 9:
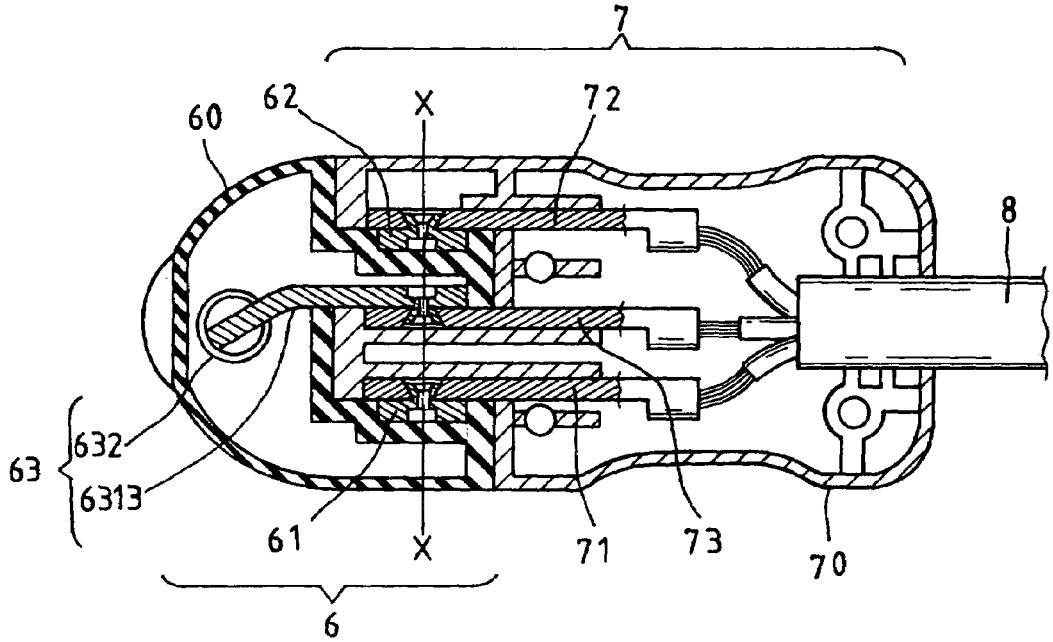
FIG. 9 is a sectional view of a swivel plug according to the present invention.
Figure 10:
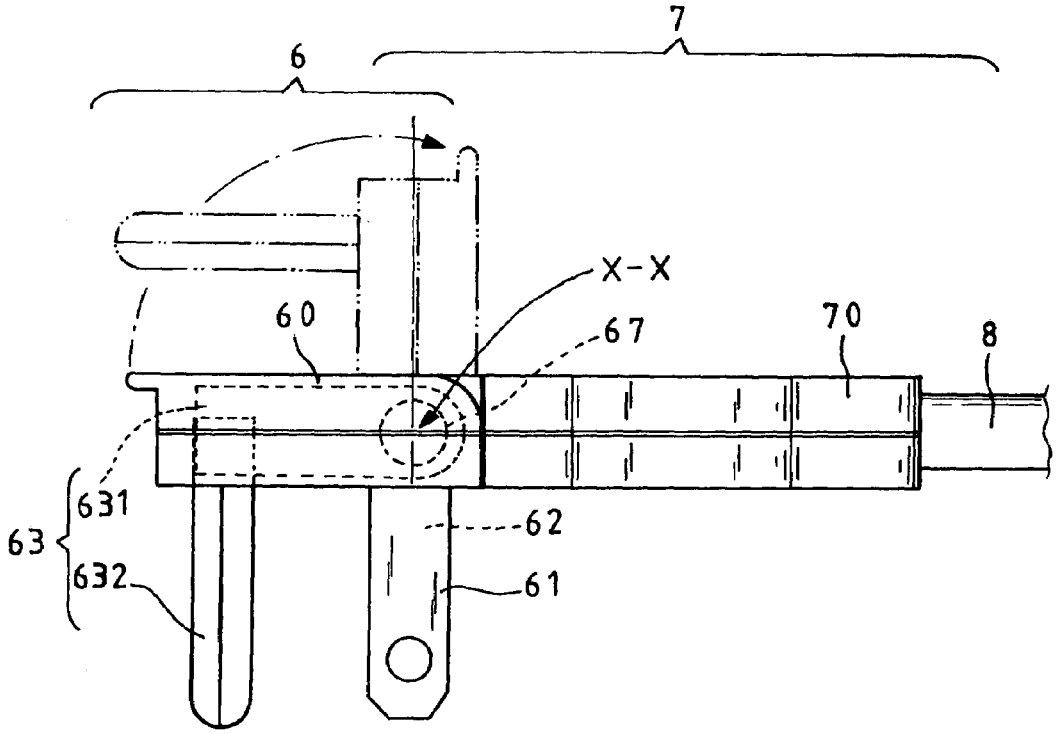
FIG. 10 is a schematic drawing showing the front plug body turned relative to the rear plug body between two positions within 90 degrees according to the present invention.
Figure 11:
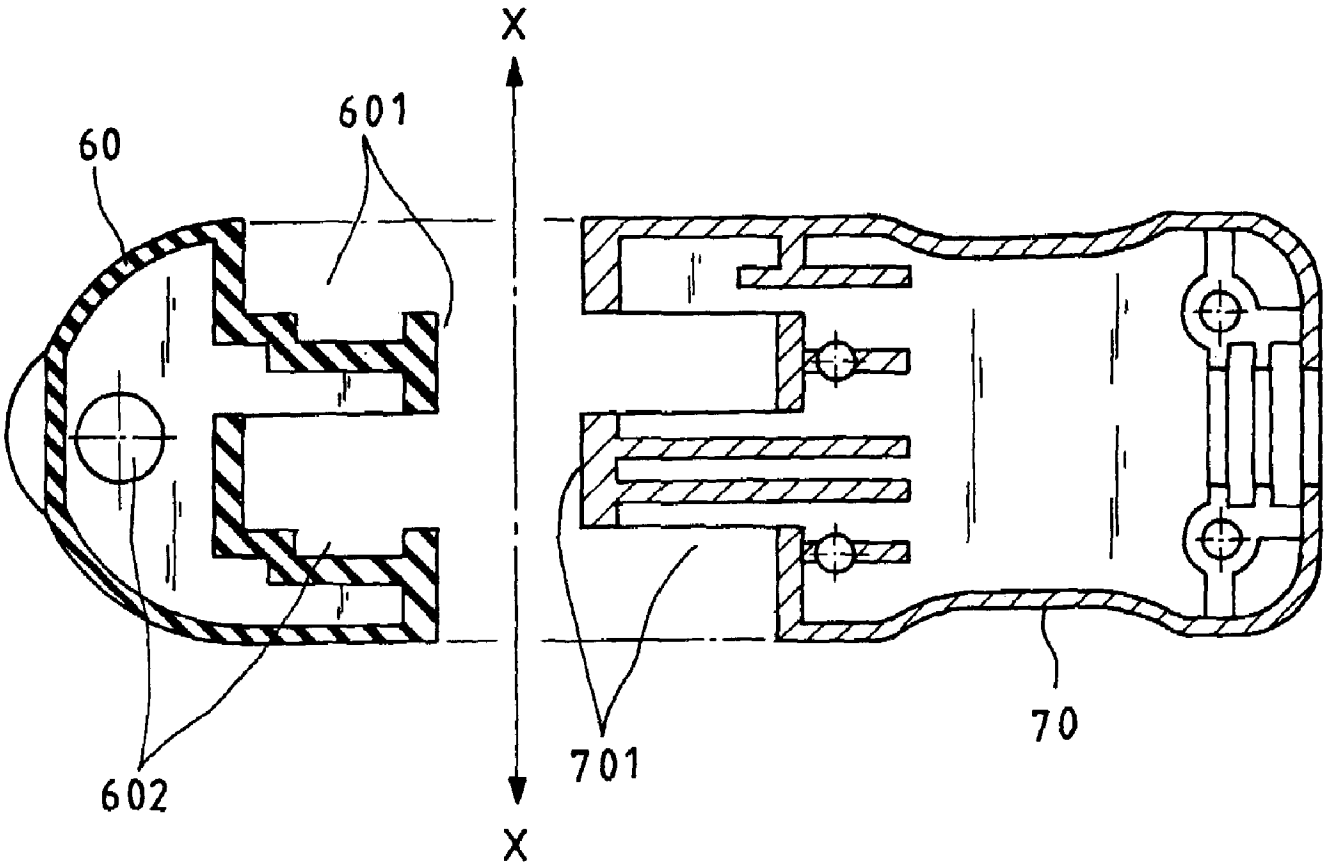
FIG. 11 is a schematic drawing showing the structure of the housing of the front plug body and the structure of the housing of the rear plug body according to the present invention.
Figure 12:
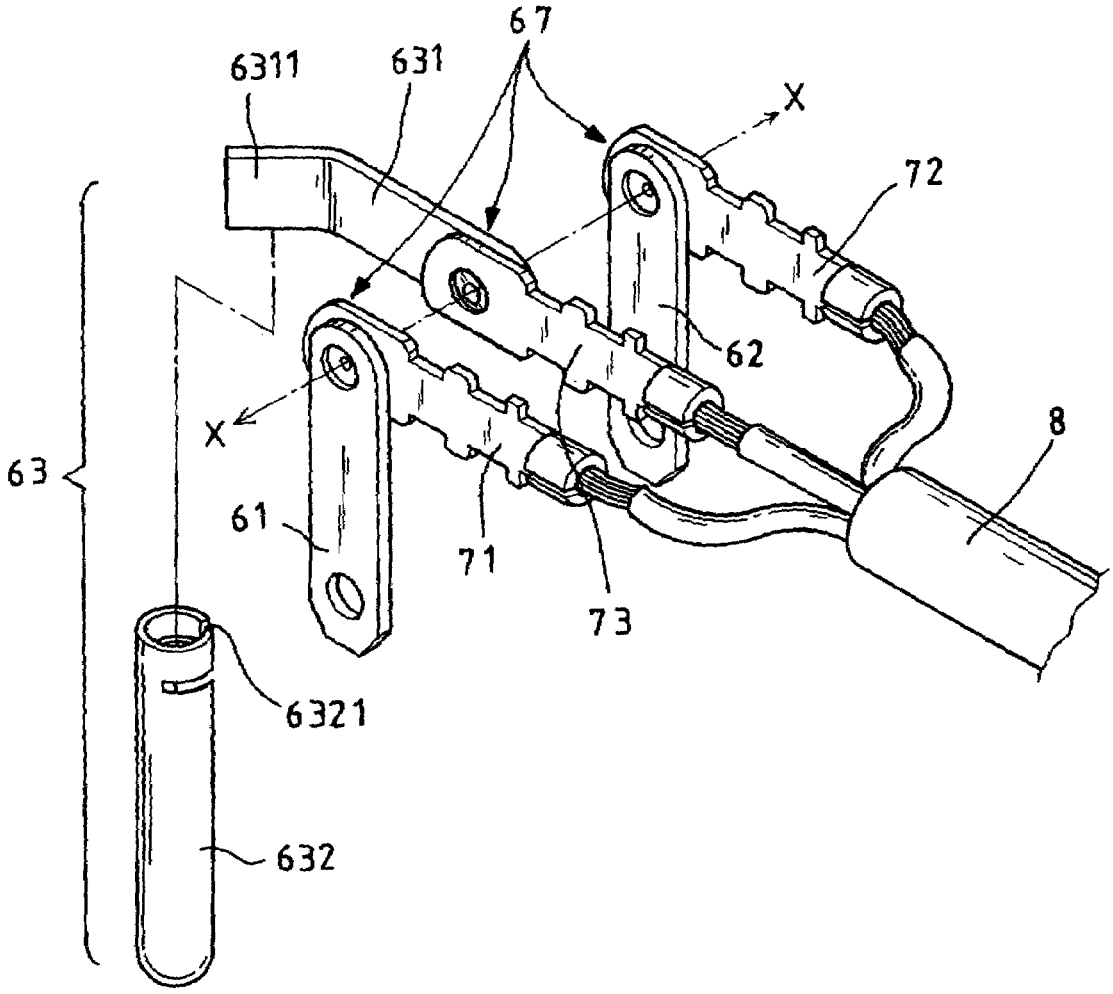
FIG. 12 is an enlarged view of a part of the present invention, showing the connection between the blades and grounding prong and the respective terminals.

Referring to FIGS. 9~11, a swivel plug is shown comprised of a front plug body 6 and a rear plug body 7. The front plug body 6 and the rear plug body 7 each comprise a respective housing 60 or 70. As shown in FIG. 11, the housing 60 of the front plug body 6 has a rear coupling portion 601; the housing 70 of the rear plug body 7 has a front coupling portion 701 fitting and pivotally connected to the rear coupling portion 601 of the housing 60 of the front plug body 6.

Referring to FIG. 12 and FIGS. 9~11 again, the front plug body 6 further comprises a positive pole blade 61, a negative pole blade 62, and a grounding prong 63. The blades 61,62 and the grounding prong 63 are respectively fastened to the inside of the housing 60 of the front plug body 6 and extended out of the housing 60 through a respective hole 602 in the housing 60. The rear plug body 7 further comprises a positive pole terminal 71, a negative pole terminal 72, and a grounding terminal 73 respectively connected to a respective conductor in a power cord 8. The blades 61,62 and the grounding prong 63 are respectively pivoted to the positive pole terminal 71, negative pole terminal 72 and grounding terminal 73 of the rear plug body 7 by a respective pivot 67. The pivots 67 are axially aligned in a line X—X. The blades 61,62 and the grounding prong 63 may be variously embodied to meet the related electric codes of different countries. According to the embodiment shown in FIGS. 10 and 12, the blades 61,62 and the grounding prong 63 are perpendicularly extended out of the bottom side of the housing 60 of the front plug body 6. Alternatively, the blades 61,62 and the grounding prong 63 can be made extended out of the front side of the housing 60 of the front plug body 6 in horizontal with the housing 60. Further, the grounding prong 63 is an angled prong having a longitudinal part 631 and a transverse part 632. The longitudinal part 631 and the transverse part 632 can be so made that the longitudinal part 631 has one end pivoted to the grounding terminal 73 and the other end formed integral with one end of the transverse part 632. Alternatively, the longitudinal part 631 and the transverse part 632 can be so made that the longitudinal part 631 has one end pivoted to the grounding terminal 73 and the other end terminating in a plug portion 6311 fastened to a retaining hole 6321 in one end of the transverse part 632 (see FIG. 12).

Figure 13:
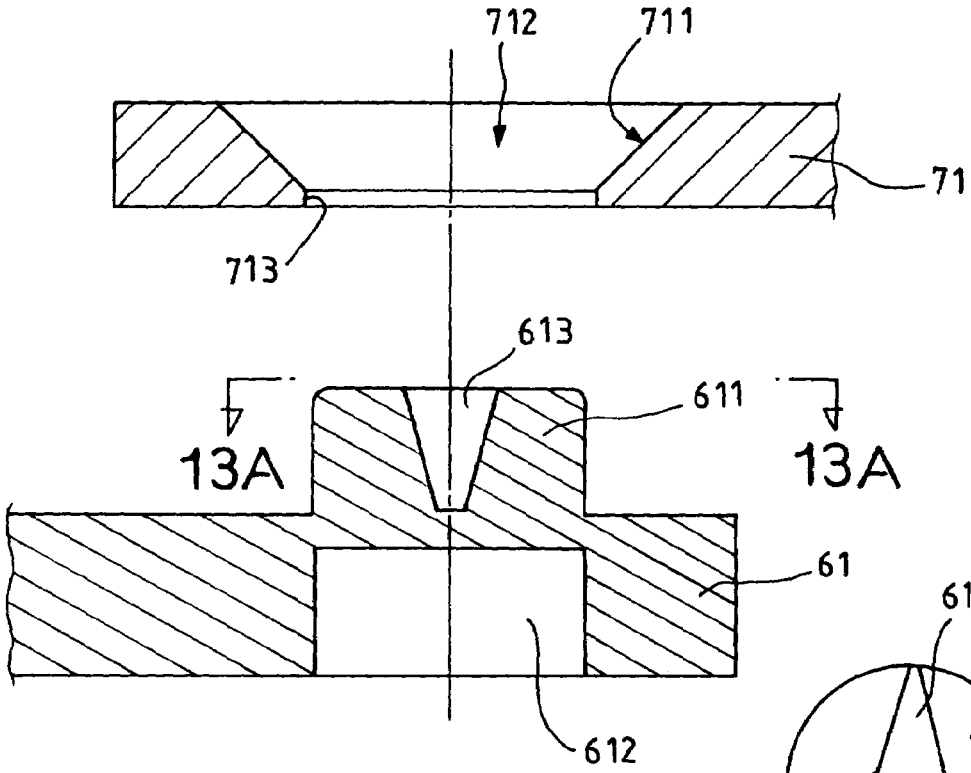
FIG. 13 is a schematic drawing showing the connection between the lade and the respective terminal according to the present invention (I).
Figure 13A:
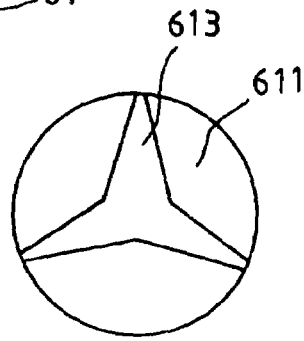
FIG. 13A is a sectional view taken in an enlarged scale along line 13A—13A of FIG. 13.
Figure 14:
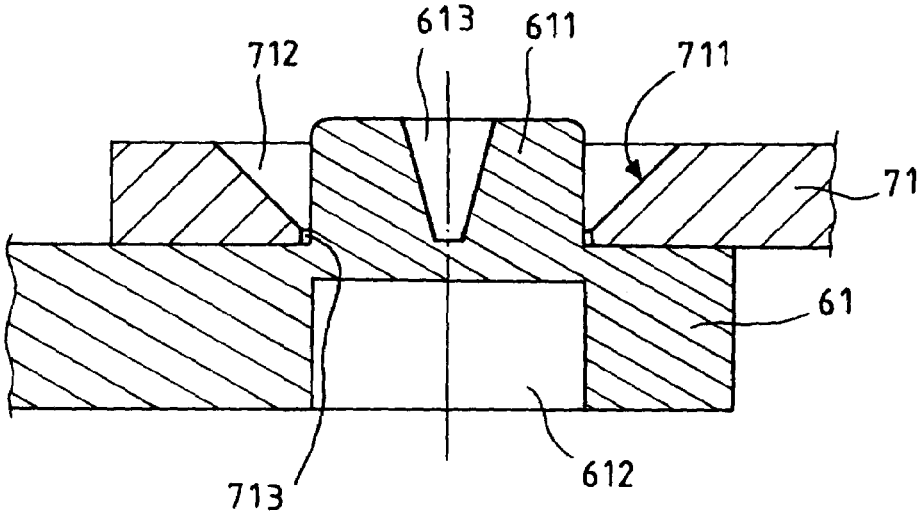
FIG. 14 is a schematic drawing showing the connection between the blade and the respective terminal according to the present invention (II).
Figure 15:
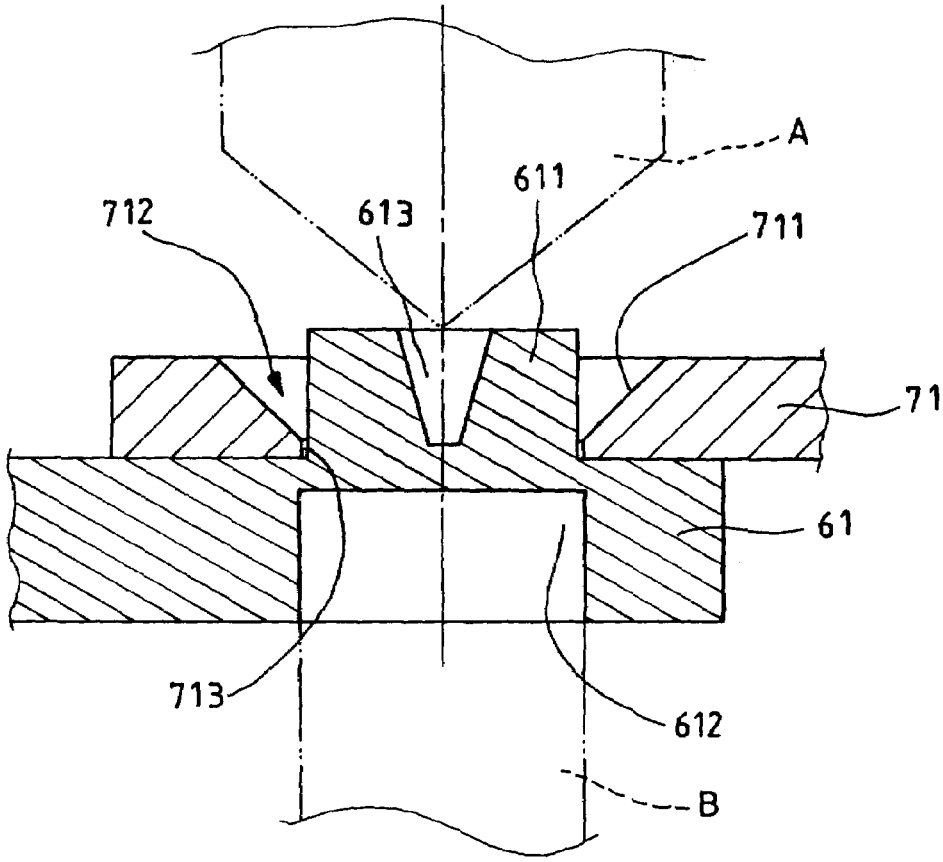
FIG. 15 is a schematic drawing showing the connection between the blade and the respective terminal according to the present invention (III).
Figure 16:
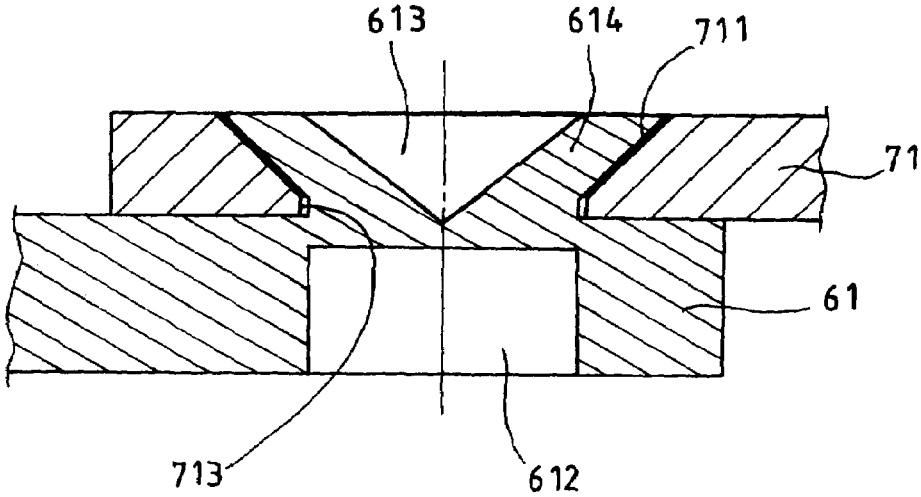
FIG. 16 is a schematic drawing showing the connection between the blade and the respective terminal according to the present invention (IV).

In order to achieve good electric conductivity and positive connection, the blades 61,62 and grounding prong 63 and the terminals 71,72,73 must be specially designed. As shown in FIGS. 13 and 14, the blade 61 has the rear end (the end to be pivoted to the respective terminal 71) stamped, thereby forming a split protrusion 611 and an axial hole 612 at the bottom side of the split protrusion 611. The protrusion 611 has radial crevices 613 (see FIG. 13A). The terminal 71 has a coupling hole 712 for receiving the split protrusion 611. The coupling hole 712 has a tapered periphery 711. After insertion of the split protrusion 611 of the blade 61 into the coupling hole 712 of the terminal 71 (see FIG. 14), an upper die A and a bottom die B are attached to the split protrusion 611 at the top and bottom sides respectively (see FIG. 15) and then pressed to expand the radial crevices 613 of the split protrusion 611, and therefore the split protrusion 611 forms a plurality of radial spring arms 614 that are pressed on the tapered periphery 711 within the coupling hole 712 of the terminal 71 (see FIG. 16). Thus, the blade 61 is pivoted to the terminal 71 without an external rivet or pivot means. Further, the coupling hole 712 of the terminal 71 has a vertical section 713 at the bottom side of the tapered periphery 711 that prevents locking of the blade 61 to the terminal 71. The connection between the other blade 62 or grounding terminal 63 and the respective terminal 72 or 73 is achieved in the same manner.

As an alternate form of the present invention, the terminals 71,72,73 are made having the aforesaid split protrusion 611 and the blade 61,62 or grounding prong 63 is made having the aforesaid coupling hole 712 with a tapered periphery 711.

Figure 17:
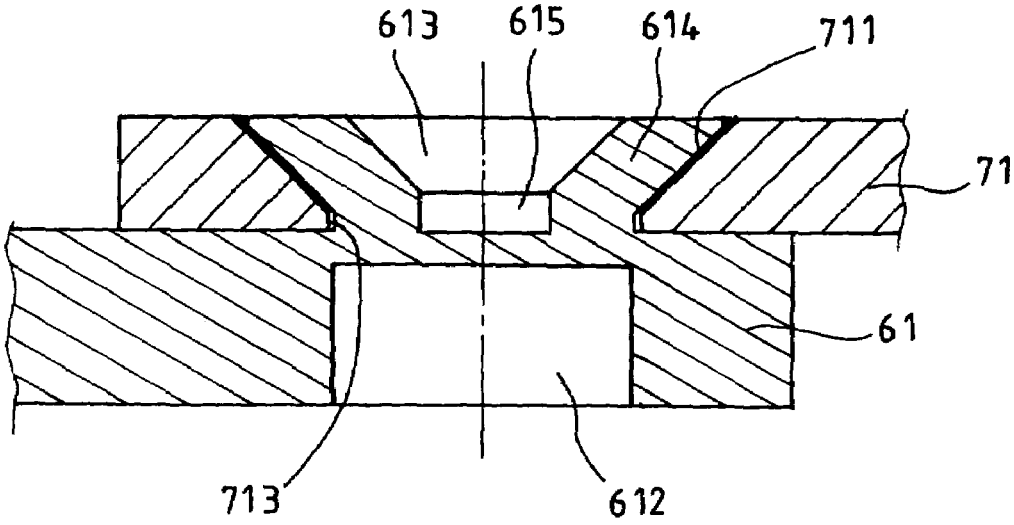
FIG. 17 is a schematic drawing showing the connection between the blade and the respective terminal according to the present invention (V).
Figure 18:
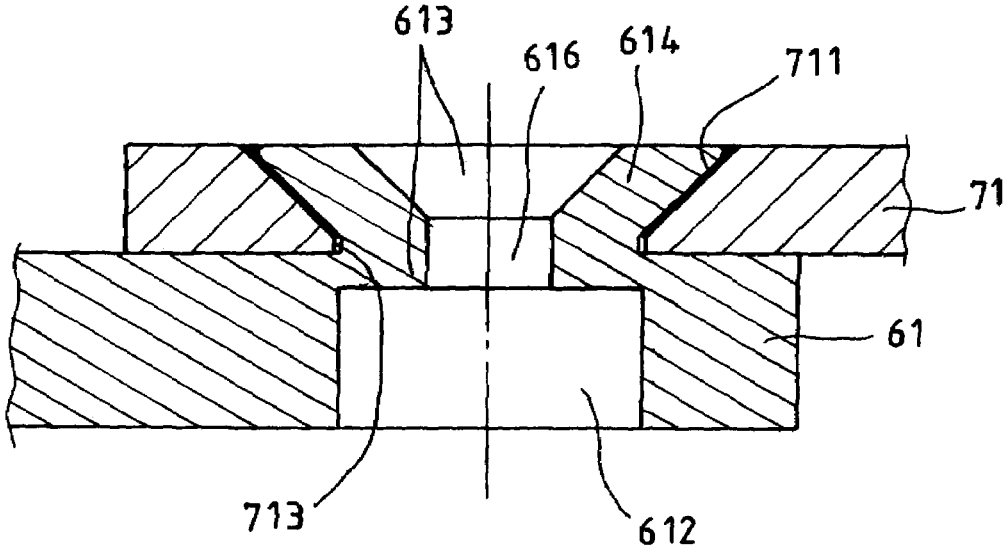
FIG. 18 is a schematic drawing showing the connection between the blade and the respective terminal according to the present invention (VI).
Figure 19:
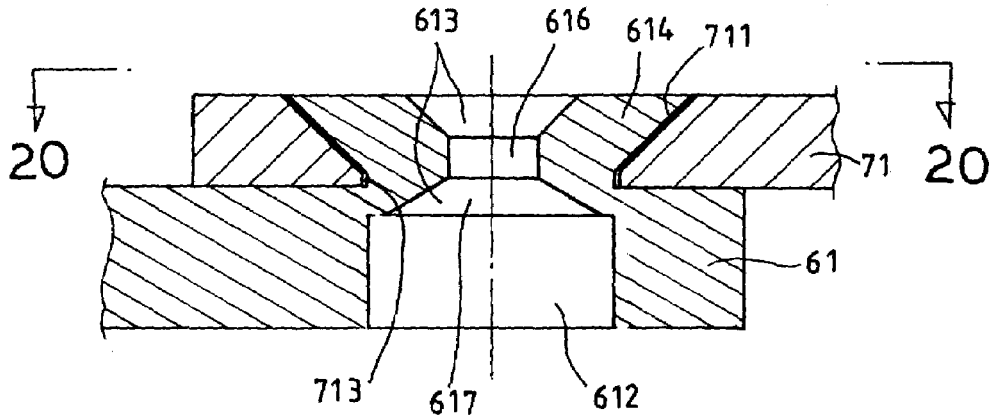
FIG. 19 is a schematic drawing showing the connection between the blade and the respective terminal according to the present invention (VII).
Figure 20:
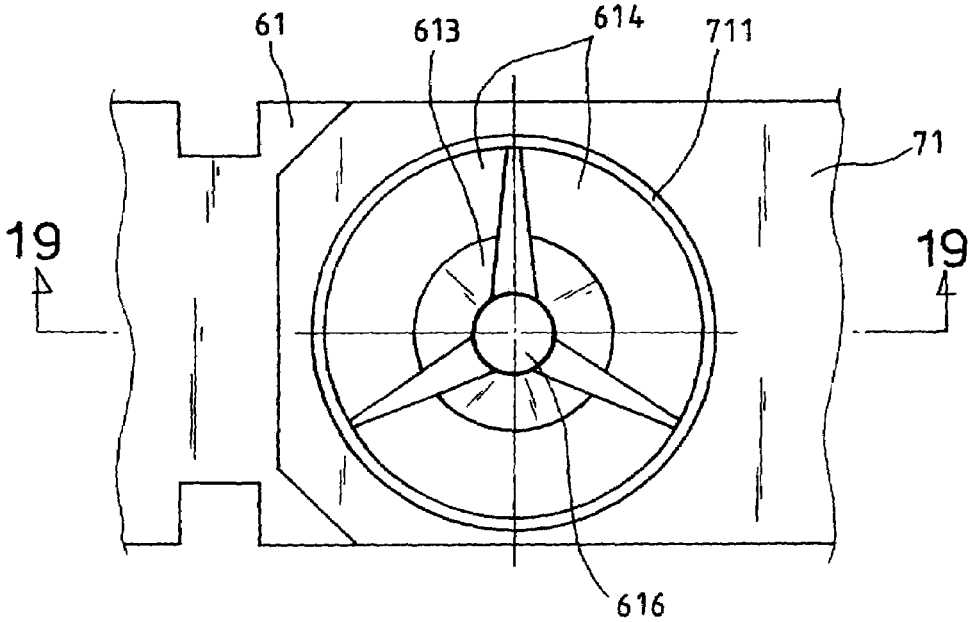
FIG. 20 is a top view of FIG. 19.

Further, a recessed hole 615 (see FIG. 17) or through hole 616 (see FIG. 18) may be formed in the bottom side of the radial crevices 613. Further, a tapered hole 617 may be formed in between the axial hole 612 and the through hole 616 (see FIG. 19). The tapered hole 617 having a diameter made gradually reduced from the axial hole 612 toward the through hole 616. FIG. 20 is a top view showing the radial spring arms 614 extended out and pressed on the tapered periphery 711 within the coupling hole 712 (not shown) of the terminal 71.

Figure 21:
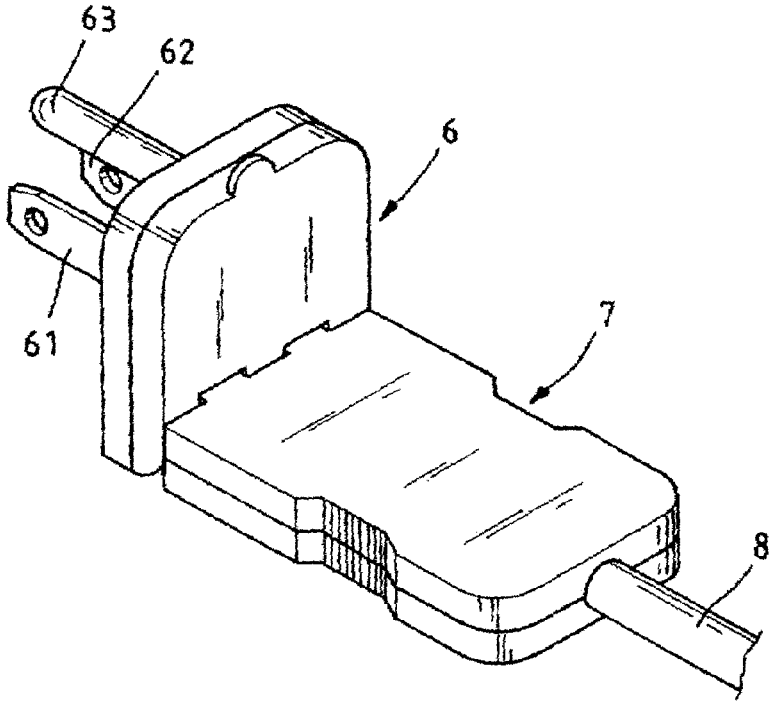
FIG. 21 is an elevational view of the swivel plug according to the present invention.
Figure 22:
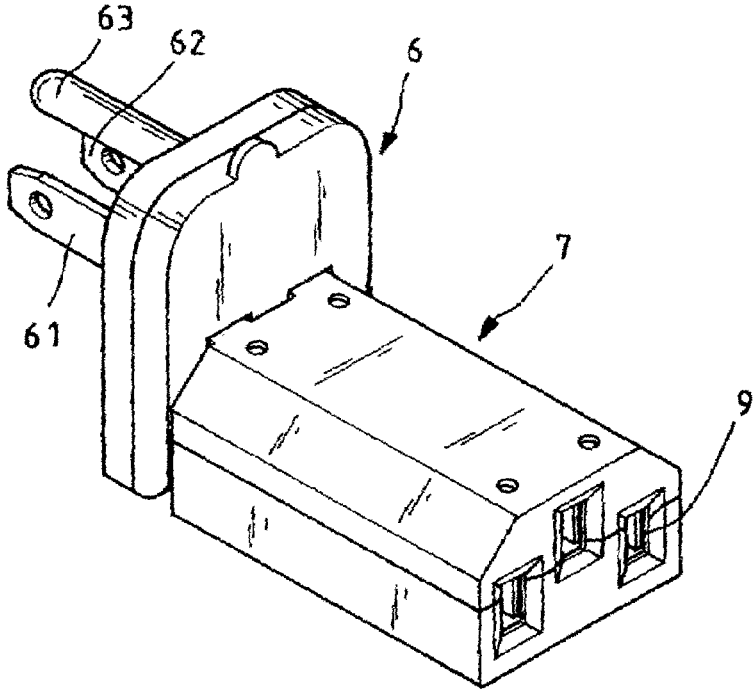
FIG. 22 is an elevational view of an alternate form of the swivel plug according to the present invention.

FIG. 21 is an elevational view of the swivel plug according to the present invention. As illustrated, the front plug body 6 is coupled to the rear plug body 7 and turnable relative to the rear plug body 7 between a horizontal position and a vertical position, and the rear plug body 7 has a power cord 8 extended out of the rear side. FIG. 22 is an elevational view of an alternate form of the swivel plug according to the present invention. According to this embodiment, the rear plug body 7 has an electric socket 9 formed in the rear side.

As indicated above, the connection between the blade or grounding prong and the respective terminal is achieved by stamping to reduce the manufacturing cost. Because the radial spring arms of the blade (or grounding prong) are pressed on the tapered periphery within the coupling hole of the respective terminal, the contact area between the blade (or grounding prong) and the respective terminal is relatively increased. Because no external rivet or pivot means is used, the total height is relatively reduced. Because the split protrusion of the blade (or grounding prong) is processed into radial spring arms that are pressed on the tapered periphery with the coupling hole of the respective terminal, the blade (or grounding prong) can be freely turned relative to the respective terminal without falling when maintained in close contact with the respective terminal.

A prototype of angle-adjustable plug has been constructed with the features of FIGS. 9~22. The angle-adjustable plug functions smoothly to provide all of the features discussed earlier.

Although particular embodiments of the present invention have been shown and described, it will be understood that various modifications and changes could be made thereunto without departing from the spirit and scope of the invention disclosed.

What is claimed is:

1. A swivel plug comprising:

a front plug body, said front plug body comprising a housing, and a plurality of metal conducting plug elements fastened to and partially extended out of the housing of said front plug body, said metal conducting plug elements each having a coupling end; and a rear plug body, said rear plug body comprising a housing coupled to the housing of said front plug body and turnable relative to the housing of said front plug body between a horizontal position and a vertical position, and a plurality of terminals, said terminals each having a coupling end respectively pivoted to the coupling ends of said metal conducting plug elements of said front plug body;

wherein the coupling end of one said terminal and the coupling end of the respective metal conducting plug element include a female coupling end and a male coupling end, said female coupling end having a coupling hole, said coupling hole having a tapered periphery, said male coupling end having a split protrusion protruded from one side thereof and inserted into the tapered coupling hole of the respective female coupling end, said split protrusion being expanded into at least one radial spring arm pressed on the tapered periphery of the respective coupling hole.

2. The swivel plug as claimed in claim 1, wherein said split protrusion has a recessed top hole and a recessed bottom side respectively formed in top and bottom sides thereof.

3. The swivel plug as claimed in claim 2, wherein said split protrusion further has an axial through hole in communication between said recessed top hole and said recessed bottom hole.

4. The swivel plug as claimed in claim 1, wherein said split protrusion has a plurality of radial crevices.

5. The swivel plug as claimed in claim 1, wherein said terminals each have a rear end respectively connected to the three conductors of a 3-wire power cord.

6. The swivel plug as claimed in claim 1, wherein said metal conducting plug elements include a positive pole blade, a negative pole blade, and a grounding prong; said terminals include a positive pole terminal, a negative pole terminal, and a grounding terminal.

7. The swivel plug as claimed in claim 6, wherein said metal conducting plug elements are respectively perpendicularly extended out of a bottom wall of the housing of said front plug body.

8. The swivel plug as claimed in claim 6, wherein said metal conducting plug elements are respectively extended out of a front side of the housing of said front plug body in axial alignment with the housing of said front plug body.

9. The swivel plug as claimed in claim 6, wherein said grounding prong is an angled prong having a longitudinal part fastened to the inside of the housing of said front plug body and coupled to the respective terminal and a transverse part suspended outside the housing of said front plug body.

10. The swivel plug as claimed in claim 9, wherein said transverse part has a retaining hole formed in a rear end thereof; said longitudinal part has a front end terminating in a plug portion and fastened to the retaining hole of said transverse part.

* * * * *